United States Patent [19]

Schlanger

[11] Patent Number: 4,763,938

[45] Date of Patent: Aug. 16, 1988

[54] HETEROGENEOUS WIRE AND PANE PROVIDED WITH SUCH A WIRE

[76] Inventor: Albert Schlanger, Apartment 103, 725 Don Mills Road, Toronto, Ontario, Canada, M3C 1S6

[21] Appl. No.: 924,243

[22] Filed: Oct. 20, 1986

[51] Int. Cl.[4] ..... E05C 19/18

[52] U.S. Cl. ..... 292/290

[58] Field of Search ..... 292/289–298

[56] References Cited

U.S. PATENT DOCUMENTS

| | | | |
|---|---|---|---|
| 980,498 | 1/1911 | Day | 292/293 |
| 1,316,223 | 9/1919 | Danner | 292/294 |
| 1,477,731 | 12/1923 | Ulrich | 292/294 |
| 1,598,081 | 8/1926 | Japs | 292/289 X |
| 2,067,779 | 1/1937 | Morden | 292/290 X |
| 2,461,398 | 2/1949 | Sands | 292/297 |
| 4,290,635 | 9/1981 | McKenzie | 292/290 |
| 4,387,919 | 6/1983 | Quaintance et al. | 292/296 |

*Primary Examiner*—Richard E. Moore

*Attorney, Agent, or Firm*—Robert F. Delbridge; Arne I. Fors

[57] ABSTRACT

A portable door lock is provided for a door having a latch engageable in an aperture in a latch plate secured to a door frame, the latch plate having a tongue extending into the aperture from a front edge of the latch plate, and the tongue being spaced from the top and bottom of the aperture. The door lock includes a retainer positionable against the latch plate to permit closing of the door and having a pair of vertically spaced fingers insertable into the latch plate aperture to engage the front edge thereof above and below the latch plate tongue. A retainer shaft extends forwardly from the retainer and has a screw-thread portion, and a holding bracket has a medial portion slidably mounted on the shaft and rearwardly projecting holding arms at opposite ends. A holding nut threadingly engages the screw-threaded portion of the retainer shaft to hold the bracket arms against the door frame and the door respectively, when the door is closed and the retainer is engaged with the latch plate, to prevent the door from being opened.

2 Claims, 3 Drawing Sheets

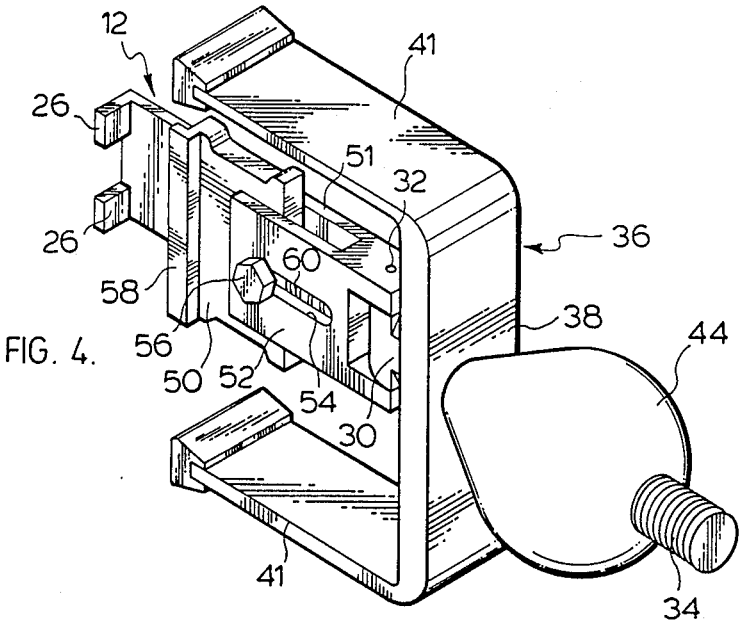
FIG. 4.
FIG. 5.
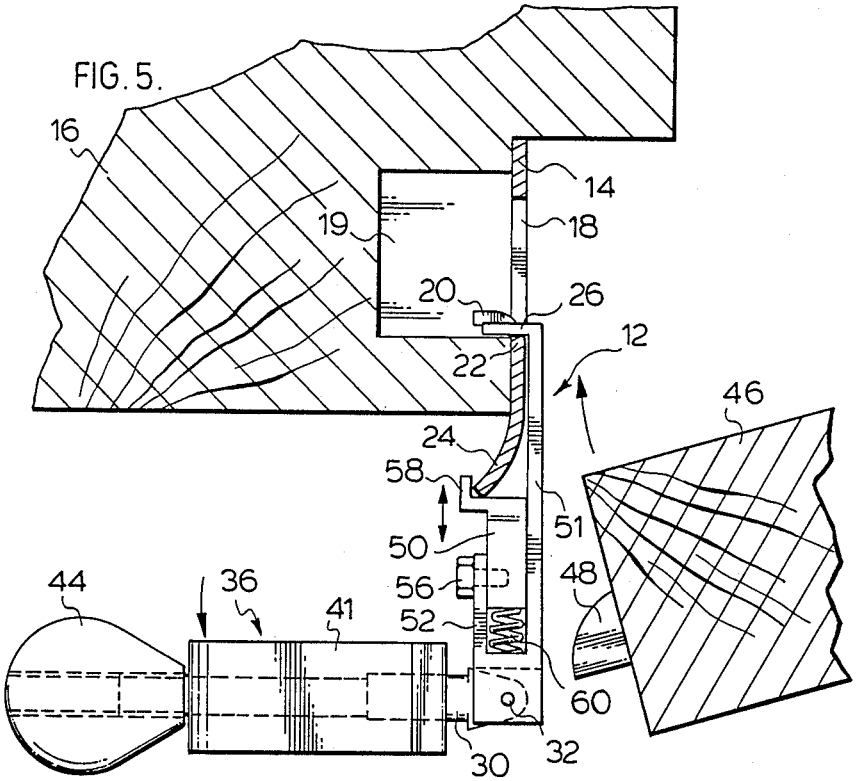

HETEROGENEOUS WIRE AND PANE PROVIDED WITH SUCH A WIRE

This invention relates to portable door locks, that is to say locks which a person can readily take with them for use, for example in a hotel, to utilize as a personal door lock for added security.

Although various locks of this general kind have previously been proposed, such prior proposals have for one reason or another not been particularly successful in practice, usually because of difficulty in adequately securing the lock to a door frame. One typical example of a prior proposal of this kind is shown in U.S. Pat. No. 1,477,731 (Ulrich) issued in 1923.

It is therefore an object of the invention to provide an improved portable door lock.

The present invention utilizes the fact that most door latches engage in an aperture in a latch plate secured to a door frame and having a tongue extending into the aperture from a front edge of the latch plate, the tongue being spaced from the top and bottom of the aperture.

According to the invention, a door lock comprises a retainer positionable against the latch plate to permit closing of the door and having a pair of vertically spaced fingers insertable into the latch plate aperture to engage the front edge thereof above and below the latch plate tongue. A retainer shaft extends forwardly from the retainer and has a screw-threaded portion, and a holding bracket having a medial portion is slidably mounted on the shaft and has rearwardly projecting holding arms at opposite ends. A holding nut threadingly engages the screw-threaded portion of the retainer shaft to hold the bracket arms against the door frame and the door respectively when the door is closed and the retainer is engaged with the latch plate, to prevent the door from being opened.

The provision of the vertically spaced fingers on the retainer which engage the front edge of the aperture above and below the latch plate tongue in accordance with the invention enables the portable door lock to be more adequately secured to the latch plate and door frame.

The retainer may also have a keeper slidably mounted thereon with spring means resiliently urging the keeper towards the retainer fingers. The keeper has a shaped leading end engageable with a front edge of the latch plate, when the retainer fingers are engaged in the latch plate aperture, to even more firmly retain the lock in assembly with the latch plate.

Figure 1:
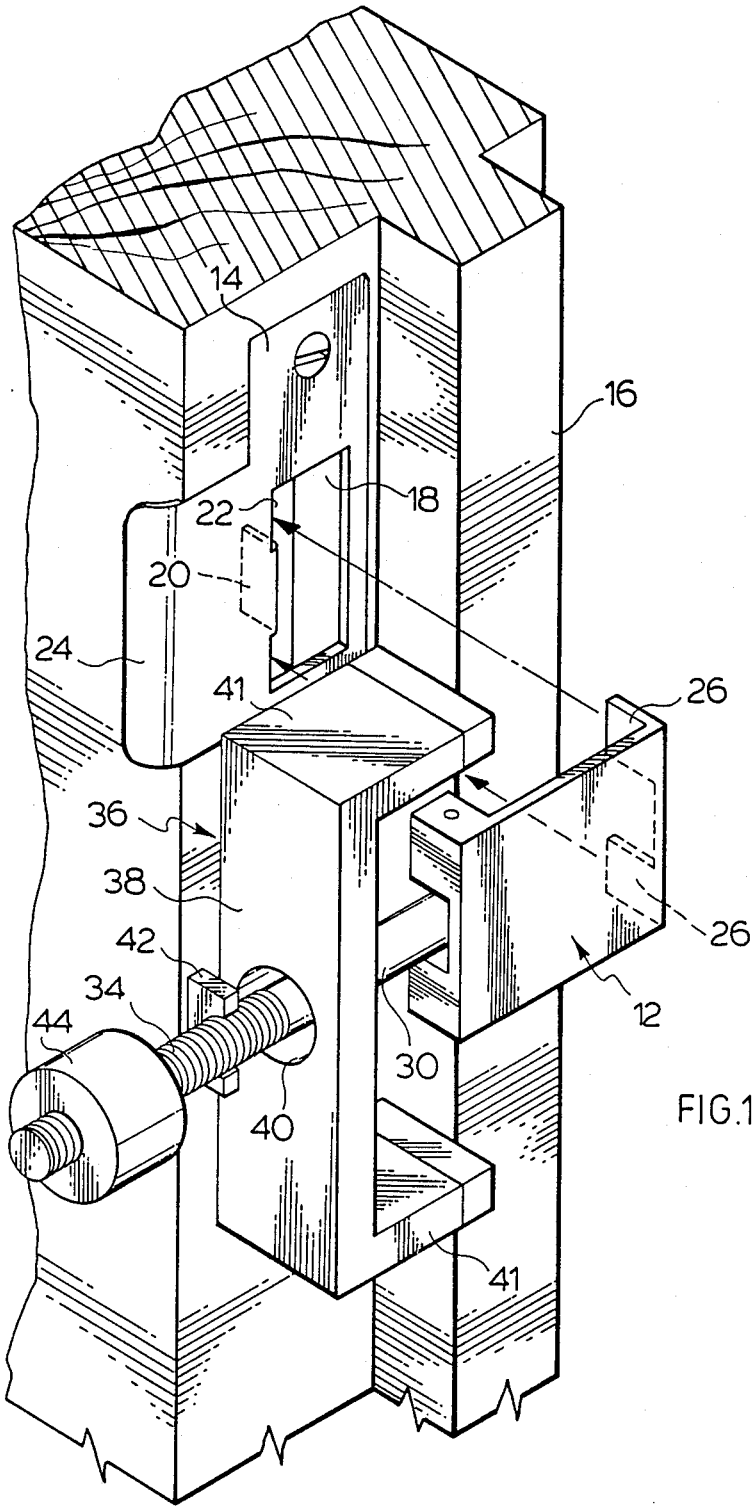
Figure 2:
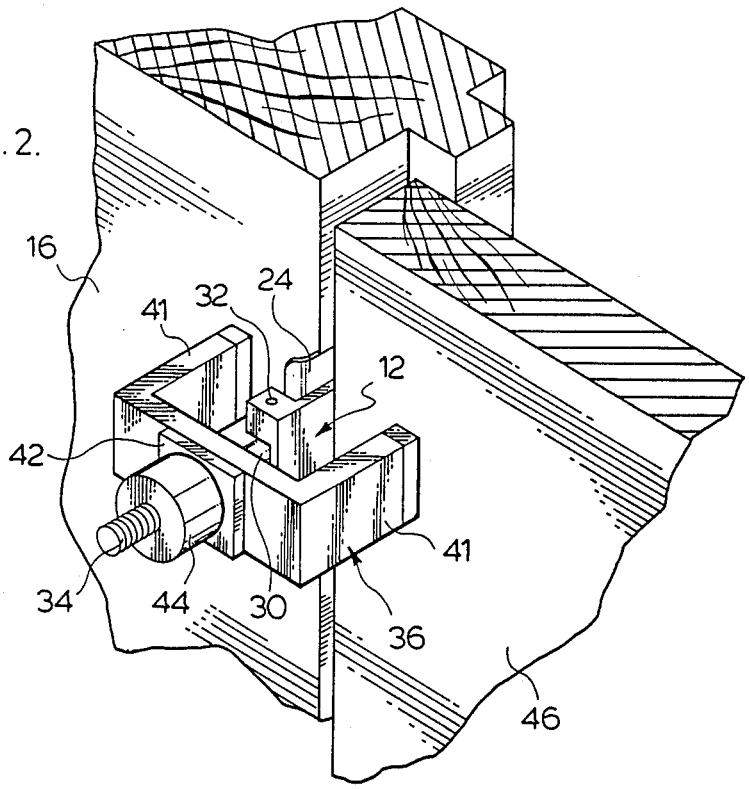
Figure 3:
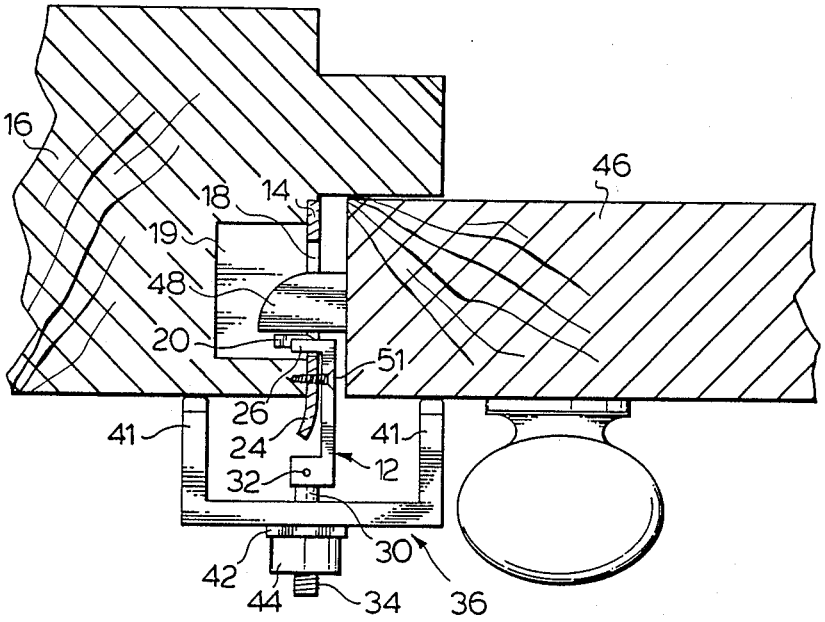

Embodiments of the invention will now be described, by way of example, with reference to the accompanying drawings, in which:

FIG. 1 is a perspective view of a portable door lock in accordance with one embodiment positioned ready for attachment to a latch plate secured to a door frame, FIG. 2 is a similar view showing the door lock in place with the door closed, FIG. 3 is a horizontal sectional view through the assembly of FIG. 2, FIG. 4 is a perspective view of a door lock in accordance with another embodiment, and FIG. 5 is a horizontal sectional view showing the attachment of the door lock of FIG. 4 to a latch plate.

Referring first to FIGS. 1 to 3, a portable door lock comprises a retainer 12 with a plate-like body portion positionable against a latch plate 14 secured to a door frame 16. The latch plate 14 has a conventional rectangular aperture 18 and tongue 20 extending into the aperture 18 from a front edge 22 thereof, the tongue 20 being spaced from the top and bottom of the aperture 18. The latch plate 14 also has a conventional forward curved portion 24 projecting forwardly from the door frame 16. The door frame 16 has a conventional recess 19 behind the latch plate 14 and communicating with the latch plate aperture 18.

The retainer 12 is positionable against the latch plate 14 to permit closing of the door, and has a pair of vertically spaced laterally-extending co-planar fingers 26 extending from a rear end of the plate-like body portion of the retainer 12 in a plane substantially perpendicular to the plate-like body portion. The fingers 26 are insertable into the latch plate aperture 18 and door frame recess 19 to engage the front edge 22 of the latch plate aperture 18 above and below the tongue 20, thereby providing secure engagement with the latch plate 14. A retainer shaft 28 extends forwardly from the retainer 12 and is pivotally secured thereto by hinge pin 30. The retainer shaft 30 has a screw-threaded front end portion 34.

The door lock also has a holding bracket 36 with a medial portion 38 slidably mounted on the retainer shaft 28, the medial portion 38 having an aperture 40 through which the retainer shaft 28 passes. The holding bracket 36 has rearwardly projecting arms 41 at opposite ends of the medial portion 38. A pair of holding nuts 42, 44 threadingly engage the screw-threaded front end portion 34 of the retainer shaft 28.

In use, with the door open, the door lock is positioned as shown in FIG. 1 with the holding bracket arms 41 in a vertical orientation. The retainer 12 is engaged with the latch plate 40, and the fingers 26 are engaged with the front edge 22 of the latch plate aperture 18 above and below the tongue 20. Referring now to FIGS. 2 and 3, the door 46 is then closed so that its catch 48 engages in the latch plate aperture 18. The holding bracket 36 is then turned to position the bracket arm 41 in a horizontal orientation, with one arm 41 engaging the door frame 16 and the other arm 41 engaging the closed door 46. The holding nuts 42, 44 are then consecutively tightened to hold the assembly tightly in place.

It is then impossible for anyone to open the door 46 from the outside, even if the catch 48 is withdrawn from the latch plate aperture 18, since retainer 12 is firmly held in assembly with the front edge 22 of the latch plate aperture 18 and the holding bracket arms 41 firmly engage the door 46 and the door frame 16 respectively. If desired, as shown in FIG. 3, the retainer 12 may be semi-permanently secured to the door frame 16 by drilling holes through the retainer 12 and latch plate 14 and screwing a screw 49 through the holes into the door frame 16.

The embodiment shown in FIGS. 4 and 5 is generally similar to the previously described embodiment, with the same reference numerals being used where applicable. However, to further improve engagement of the retainer 12 with the latch plate 14, the retainer 12 is provided with a keeper 50 which is slidably mounted thereon. The keeper 50 is mounted between the main plate-like body 51 of the retainer 12 and an integral mounting plate 52 with a slot 54. A bolt 56 secured to the keeper 50 is slidable in the slot 54.

The keeper 50 has a shaped front end to provide a finger 58 engageable with the front edge of the front latch plate portion 24. The keeper 50 is resiliently urged into engagement with the front edge of the front latch plate portion 24 by spring 60 acting between the keeper 50 and an adjacent part of the retainer 12.

The door lock of FIGS. 4 and 5 can readily be assembled with the latch plate 14 (with the door 46 open) by holding the keeper 50 away from the fingers 26 against the action of the spring 60 engaging the fingers 26 with the front edge 22 of the latch plate aperture 18, and then releasing the keeper 50 so that the spring 60 forces the keeper finger 58 into engagement with the front edge of the latch plate 14.

The manner in which the door lock is then held in engagement with the latch plate 14 can readily be seen in FIG. 5. The door 46 can then be closed, and the holding bracket 36 secured in place against the door 46 and door frame 16 in the same manner as in the previous embodiment.

Other embodiments will be readily apparent to a person skilled in the art, the scope of the invention being defined in the appended claims.

What I claim as new and desire to protect by Letters Patent of the United States is:

1. A locked door assembly comprising a door frame, a latch plate secured to the door frame, said latch frame having an aperture and a tongue extending from a front edge of the aperture into a recess in the door frame, said tongue being spaced from the top and bottom of the aperture, a door in a closed position in the door frame, said door having a latch engaged in the aperture in the latch plate and in the recess in the door frame to retain the door in the closed positon, and a portable door lock, said portable door lock comprising a retainer with a plate-like body portion positioned against the latch plate between the door and the door frame, said plate-like body portion having a pair of vertically spaced coplanar fingers extending from a rear end of the plate-like body portion substantially perpendicularly to the plate-like body portion into the latch plate aperture and engaging the front edge thereof above and below the latch plate tongue, a retainer shaft extending forwardly from the retainer and having a screw-threaded portion, a holding bracket having a medial portion slidably mounted on the shaft and having rearwardly projecting holding arms at opposite ends, and a holding nut threadingly engaging the screw-threaded portion of the retainer shaft and engaging the bracket to hold the arms against the door frame and the door respectively and prevent the door from being opened.

2. A locked door assembly according to claim 1 wherein the retainer has a keeper slidably mounted thereon and spring means resiliently urging the keeper towards the retainer fingers, said keeper having a shaped leading end engageable with a front edge of the latch plate when the retainer fingers are engaged in the latch plate aperture to retain the lock in assembly with the latch plate.

* * * * *